US005993918A

United States Patent [19]

Groshens et al.

[11] Patent Number: 5,993,918

[45] Date of Patent: Nov. 30, 1999

[54] THERMOBONDING INTERLINING WITH DOTS OF THERMOFUSIBLE POLYMER VIA ELECTRON BOMBARDMENT AND PROCESS FOR MAKING THE SAME

[75] Inventors: Pierrot Groshens, Peronne; Patrick Noireaux, Le Mans, both of France

[73] Assignee: Lainiere de Picardie, Peronne Cedex, France

[21] Appl. No.: 09/008,742

[22] Filed: Jan. 19, 1998

[30] Foreign Application Priority Data

Jan. 20, 1997 [FR] France ..... 97 00704

[51] Int. Cl.[6] ..... B05D 3/06; B05D 1/26

[52] U.S. Cl. ..... 427/552; 427/256; 427/288

[58] Field of Search ..... 427/197, 552, 427/261, 288, 256, 340, 399, 208, 208.2, 337, 342, 282; 428/198, 200, 212, 289

[56] References Cited

U.S. PATENT DOCUMENTS

| | | | |
|---|---|---|---|
| 3,833,145 | 9/1974 | Cox et al. | 273/218 |
| 3,922,418 | 11/1975 | Lauchenauer | 428/196 |
| 4,337,296 | 6/1982 | Varadhachary | 428/420 |
| 4,748,044 | 5/1988 | Fottinger et al. | 427/197 |
| 4,874,655 | 10/1989 | Groshens | 428/198 |
| 5,543,214 | 8/1996 | Groshens | 428/261 |
| 5,668,847 | 9/1997 | Hernandez | 378/65 |

FOREIGN PATENT DOCUMENTS 2606603 5/1988 France .

*Primary Examiner*—Frederick Parker
*Attorney, Agent, or Firm*—Wolf, Greenfield & Sacks, P.C.

[57] ABSTRACT

The present invention relates to a process for manufacturing a thermobonding interlining in which dots of thermofusible polymer of mean thickness E are deposited on the front face of an interlining support, chosen from textile and non-woven supports, and one of the faces of the support is subjected to electron bombardment, wherein, as the dots of thermofusible polymer contain a radical activator and are bereft of photoinhibitor, the depth of penetration of the electrons in the dots of thermofusible polymer is adjusted in order to obtain a modification of the physico-chemical properties of the thermofusible polymer, chosen from the melting temperature and viscosity, over a limited thickness e with respect to the mean thickness E.

15 Claims, 1 Drawing Sheet

THERMOBONDING INTERLINING WITH DOTS OF THERMOFUSIBLE POLYMER VIA ELECTRON BOMBARDMENT AND PROCESS FOR MAKING THE SAME

FIELD OF THE INVENTION

The present invention relates to the field of thermobonding interlinings which are textile or non-woven supports, on one face of which are applied dots of thermofusible polymer, capable of subsequently adhering to the piece of garment to be reinforced under the effect of the application of a certain pressure under heat. It relates more particularly to a process for manufacturing such an interlining employing electron bombardment with a view to locally modifying the melting temperature and/or the viscosity of the thermofusible polymer, it also relates to a thermobonding interlining obtained by said process, of which the dots of thermofusible polymer have a differentiated melting temperature or viscosity in their thickness.

BACKGROUND OF THE INVENTION

Among all the problems encountered in the domain of thermobonding interlinings, one of the most delicate to solve consists of the risk of transpiercing the interlining support during the application of the thermobonding interlining by hot pressure against the piece of garment to be reinforced. In fact, the temperature which is chosen to effect this hot application must make it possible to effect fusion of the dot of polymer so that the polymer thus melted can spread and adhere on the surface fibers or filaments of the garment. However, it frequently happens that such distribution is not made solely on the surface, but that the polymer creeps through the fibers or filaments and appears on the opposite surface of the interlining support. This does not affect the aesthetics, unless the interlining is intended to be visible and to form the rear face of the garment. In any case, the effect of such transpiercing is to locally increase the rigidity of the interlining and therefore of the piece of garment, which may be contrary to the effect desired. It may also provoke adhesions on the lining fabrics, such as lining and parts of welting cloth, which is detrimental to the quality of the garment.

In order to solve this difficulty, it has already been proposed to produce a thermobonding interlining of which the dots of thermofusible polymer comprise two superposed layers, namely a first layer in contact with the face side of the interlining support and a second layer disposed precisely above the first. Of course, the constituents of the two layers are determined so that, when they are applied hot under pressure on the piece of garment, only the thermofusible polymer of the second layer reacts to the action of the temperature. In that case, the thermofusible polymer can only diffuse towards the piece of garment, being prevented from doing so towards the interlining support, the first layer acting to some extent as barrier.

In practice, this double-layer technique presents drawbacks, particularly the difficulty of effecting the superposition of the two layers and risk of delamination of the two layers.

In order to overcome these drawbacks, Applicants have already proposed, in document FR 2 606 603, employing means of chemical nature, acting on the thermofusible polymer with a view to modifying its chemical structure at least partially, at least at the interface with the interlining support, so as to prevent the thermofusible polymer from bonding through the interlining support under the effect of heat and/or pressure and/or vapour. The means, of chemical nature, adapted to modify the chemical structure of the thermofusible polymer comprise at least one reactive matter and at least one reactive means capable of stimulating, assuring and promoting the reaction between the reactive matter and the thermofusible polymer.

Different categories of reactive matters are explicitly cited, namely thermosetting products, carbamide resin, particularly urea-formaldehyde and malamine formaldehyde, simple molecules or polymers bearing at least one isocyanate function, blocked or not, simple molecules or polymers bearing at least one aziridine function, modified polymers bearing at least one reactive chemical function, particularly epoxy function or vinyl function.

Among the reactive means are cited additions of heat, ultraviolet radiation and electron bombardment. It is specified that this reactive means may be used in the presence of catalysts. More precisely, when the reactive means of the reaction of crosslinking of the thermofusible polymer and of the modified polymer with vinyl reactive function is UV radiation, it is provided that the latter intervenes with contacting of photoinitiator products.

Where the reactive means comprises electron bombardment, it is provided to add to the mixture of thermofusible polymer and of reactive matter a photoinhibitor agent in order to limit the propagation of the chemical reaction of modification. The interlining support coated with the mixture is passed in front of a photon or electron source located on the non-coated face of the support so that the particles preferably bombard the holes or perforations of the support, opposite the thermofusible polymer.

In practice, it has proved impossible to obtain satisfactory results under the conditions described in document FR 2 606 603, by using as reactive means an electron bombardment, despite all the interest that this technique presented. The difficulty of monitoring the propagation of the chemical reaction with the aid of photoinhibitor agents, and the difficulty of acting preferably at the level of the holes or perforations of the interlining support, opposite the thermofusible polymer, contribute to this failure.

It is an object of Applicants to propose a process for manufacturing a thermobonding interlining employing electron bombardment to modify the chemical structure of the thermofusible polymer, which overcomes the difficulties set forth hereinabove.

SUMMARY OF THE INVENTION

According to this process, dots of thermofusible polymers of mean thickness E are deposited in known manner on the front face of an interlining support, chosen from textile and nonwoven supports, and one of the faces of said support is subjected to electron bombardment.

According to a characteristic of the invention, as the dots of thermofusible polymers contain a radical activator and are bereft of photoinhibitor, the depth of penetration of the electrons in the dots of the thermofusible polymer is adjusted in order to obtain a modification of the physicochemical properties of the thermofusible polymer, chosen from the melting temperature and the viscosity, over a limited thickness e with respect to the mean thickness E.

The function of the radical activator is to create free radicals making it possible to initiate the reaction of polymerisation of the thermosfusible polymer on itself. It is similar to the photoinitiator agent provided in document FR 2 606 603 when employing UV radiation as reactive means. The radical activator is therefore, strictly speaking, not a reactive matter in the sense provided by document FR 2 606 603.

This radical activator is preferably of the acrylic type, particularly trimethylol propane trimethacrylate or trimethylol propane triacrylate. These two compounds are monomers with acrylic function and do not form part of the list explicitly provided, for the reactive matter, in document FR 2 606 603.

Thanks to the radical activator and to the absence of photoinhibitor, it is possible to obtain a structural modification of the thermofusible polymer over a limited thickness e of each dot of the thermobonding interlining.

In a first variant embodiment, the back face of the interlining support is subjected to electron bombardment and the depth of penetration of the electrons is adjusted to obtain modification of the physico-chemical properties over a thickness e included between 10 and 50% of the mean thickness E, the modification consisting in an increase in the melting temperature or in an increase in the viscosity of the thermofusible polymer.

In a second variant embodiment, the front face of the interlining support is subjected to electron bombardment and the depth of penetration of the electrons is adjusted to obtain a modification of physico-chemical properties over a limited thickness included between 50 and 90% of the mean thickness E, the modification consisting in a decrease in the melting temperature or a decrease in the vicosity of the thermoflisible polymer.

In any case, each dot of polymer is produced by a single, one-layer deposit and after the action of the electron bombardment, said layer presents a differentiated melting temperature and/or a viscosity between a first lower zone which is in contact with the textile support and which has a given melting temperature and/or viscosity and a second upper zone which has a melting temperature or a viscosity less than that of the thermofusible polymer of the first zone.

When the thermobonding interlining is applied against the piece of garment, by hot pressure, it is the second zone which is in contact with the garment piece and which presents the lowest melting temperature which will react most to the action of the heat, while the first zone which has a higher melting temperature does not react or reacts in a lesser proportion. Consequently, this first zone serves to some extent as barrier to the creeping of the thermofusible polymer of the second zone.

Whatever the variant embodiment, there is a modification of the melting temperature and/or of the viscosity which is gradual in the thickness of the dot. Consequently, there is no risk of decohesion or of delamination between two layers of different densities, as is the case when carrying out the double-layer technique, whereby each dot is constituted by two layers of different hardnesses always presenting a preferential point of rupture between the layers.

It should be noted that the beam of electrons generated by industrial electron guns does not have a uniform action in the thickness of a given matter. As the beam of electrons penetrates inside the matter, the quantity of electrons or dose decreases gradually in the thickness until it becomes zero at a given thickness, which is a function of the acceleration voltage of the electron beam. For example, for an electron gun whose acceleration voltage is 150 kV, it is considered that the dose of electrons is cancelled for a thickness of 200 $\mu$m, through a material of density 1. This dose is still of the order of 50%, in this case, for a thickness of the order of 130 $\mu$m.

Applicants have ascertained that, in order to obtain a modification of the physico-chemical properties of the thermofusible polymer such that the lower layer of the dot plays the desired effect of barrier, avoiding the transpiercing of the thermobonding interlining, it was necessary to have a certain dose of electrons which has attained the radical activator. The adjustment of the depth of penetration of the electrons, as provided by the process of the invention, therefore aims at there being this sufficient dose of electrons able to penetrate in the limited thickness e of the thermofusible polymer, i.e. the thickness for which the modification of physico-chemical properties is sought.

Being given that industrial electron guns are standardized and that it is not possible to vary the acceleration voltage thereof easily, according to the process of the invention, the depth of penetration of the electron beam in the dots of thermofasible polymer is decreased by interposing a filter between the electron beam and the interlining support. For example, interposing a filter in the path of an electron gun having an acceleration voltage of at least about 100 kV, may reduce the depth of penetration of the electrons by about 50 to 100 microns.

The effect of this filter is to artificially reduce the thickness of penetration of the electron beam in the thermofusible polymer and therefore precisely to adjust the really effective depth of penetration.

The choice of the filter, which may in particular be a sheet of paper and, in particular its thickness, is a function of the material constituting the interlining support and of the thickness e for which a modification of the physico-chemical properties is desired.

For example, for an electron gun whose acceleration voltage is 150 kV, a filter made of paper weighing about 50 to 60 g/m$^2$ is interposed.

The operating conditions of the electron bombardment and the choice and quantity of radical activator are preferably determined so that the melting temperature of the thermofusible polymer has an up or down variation, of the order of 10 to 20° C., in the zone subjected to the electron bombardment.

BRIEF DESCRIPTION OF THE DRAWINGS

The invention will be more readily understood on reading the following description of two embodiments of a thermobonding interlining of which the dots of one-layer thermofusible polymer present a differentiated melting temperature, with reference to the accompanying drawing in which.

DESCRIPTION OF PREFERRED EMBODIMENTS

Figure 1:
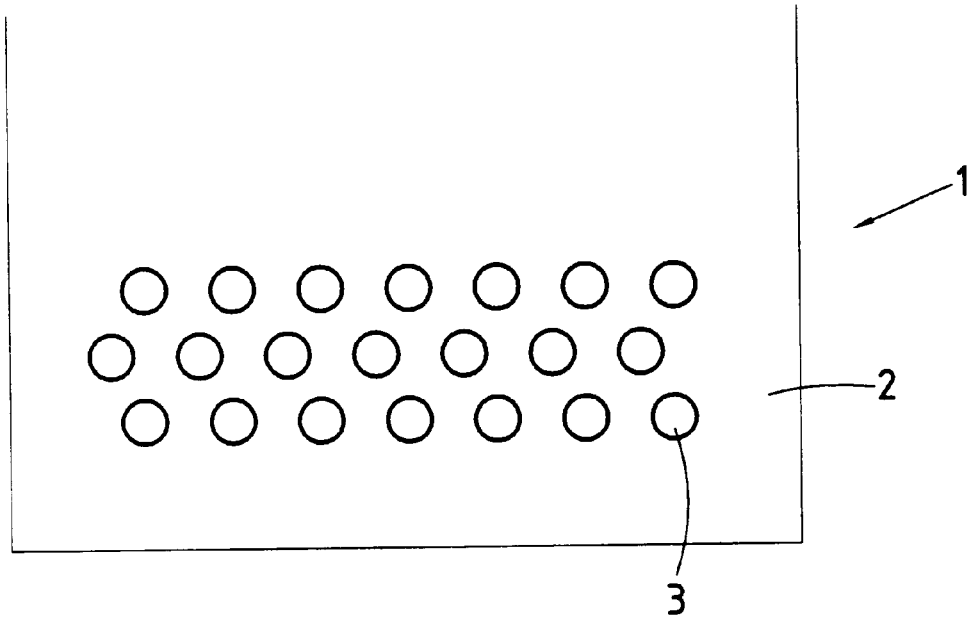
FIG. 1 schematically shows a thermobonding interlining in plan view, and considerably enlarged.

Referring now to the drawings, a thermobonding interlining 1 is constituted by a support 2 and by dots 3 of thermofusible and thermobonding polymer. The support may be either a textile support proper, of the woven, warp knitted or weft knitted type, or a non-woven fabric. The dots 3 of thermofusible polymer are disposed on all or part of the surface of one of the two faces of the support 2, called front face. It is this front face which is intended to be applied against the back face of the piece of garment to be protected or reinforced.

The thermofusible polymer is of known type, chosen among polyamides, polyethylenes, polyurethanes, polyesters, and carbamide resin. It may also be a copolymer. What is important is that the polymer in question can react, at the temperature of application of the piece of garment under hot pressure, by locally melting and adhering on the fibers or filaments of the back face of the piece of garment.

The dots of polymer are conventionally deposited in the form of an aqueous dispersion which is then subjected to a heat treatment so as to evaporate the solvent and to agglomerate the particles of thermofusible polymer again to attach them on the support. The dots of polymer are deposited by any conventional technique, particularly by rotary screen printing or the like.

In practice, the dots of polymer on the surface of the interlining support represent of the order of 5 to 20 g/m$^2$ as a function of the type of support.

The aqueous dispersion of thermofusible polymer also includes a radical activator, i.e. a compound which is able to form free radicals under the effect of electron bombardment, and is bereft of photoinhibitor agent.

By way of non-exclusive example, it is a question of an activator of the acrylic type, such as trimethylol propane trimethacrylate or trimethylol propane triacrylate. The proportion of radical activator may be included between 5 and 20% by weight with respect to the thermofusible polymer.

In a first embodiment, after having deposited the aqueous dispersion of thermofusible polymer on an interlining support 2, the polymer is then subjected to heat treatment to evaporate the water contained in the dispersion and agglomerating the mixture of thermofusible polymer and activator, the back face 2*b* of the interlining support 2, i.e. the face which does not comprise the dots 3 of polymer, is subjected to electron bombardment. The electrons pass through the filaments or fibers 4 of the support 2 and penetrate in the dot of polymer 3 where they encounter the radical activator. Under the effect of these electrons, the radical activator generates free radicals which develop reactions of cross-linking in the zone 3*a* of the thermofusible polymer.

Figure 2:
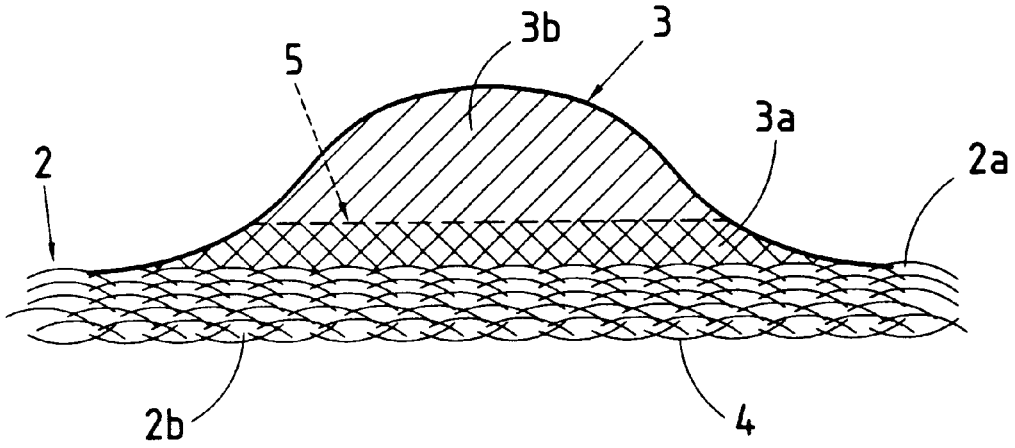
FIG. 2 schematically shows said interlining in section, at the level of a dot of polymer.

In this variant embodiment, the depth of penetration of the electrons, the quantity and the choice of the radical activator are determined so that only zone 3*a* of the thermofusible polymer which is in contact with or in the immediate proximity of the fibers or filaments 4 of the support and subjected to the action of the electrons, undergoes the desired modification of the physico-chemical properties, namely increase of the melting temperature or viscosity of the thermofusible polymer. FIG. 2 schematically shows the separation of this first zone 3*a*, of modified structure, from the second zone 3*b* of non-modified structure, by a discontinuous line 5. In fact, the action is gradual in the thickness of the dot. In any case, under the controlled action of the electron bombardment, there is created a differentiation in the thickness of each dot of polymer 3. This differentiation due to a certain cross-linking, is translated in this first example by an increase of the melting temperature of the thermofusible polymer constituting the first zone 3*a*, this melting temperature remaining unchanged as far as the second zone 3*b* not significantly modified by the action of the electrons is concerned.

It should be noted that each dot of thermofusible polymer in which the electrons penetrate constitutes a solid medium. Consequently, the reactions of cross-linking generated thanks to the free radicals propagate only very slightly, contrary to what might happen if it were question of a liquid medium.

When the thermobonding interlining 1 is applied under hot pressure on the piece of garment, at the temperature usually employed for the thermofusible polymer in question, only the second zone 3*b* of each dot 3 reacts, i.e. exerts its adherent power by fusion of the thermofusible polymer. The temperature of application is insufficient, due to the increase of its melting temperature, to cause the polymer contained in the first zone 3*a* to react. Thus, during the application under pressure, the polymer of the second zone 3*b* cannot creep through the fibers or filaments 4 of the support 2, such creeping being prevented by the first zone 3*a* of the dot 3, which does not react and acts as barrier.

So that this barrier effect can be effective without reducing the adherent action of each dot 3 beyond measure, the operating conditions, and in particular the depth of penetration of the electrons, are determined so that the relative thickness of the first zone 3*a* is included between 10 and 50% of the total thickness of the dot of polymer 3, and preferably between 10 and 20%.

Polyamides or high density polyethylenes or polyurethanes were used as thermoflisible polymers, and, as radical activators, trimethylol propane trimethacrylate or trimethylol propane triacrylate at a rate of 5 to 20% by weight of polymer. The thermofusible polymer was deposited at a rate of 9 to 16 g/m$^2$ on the interlining support. An electron gun was used, with doses included between 10 and 75 KGy and acceleration voltages of 100 to 200 kV. The depth of penetration of the electrons was adjusted by interposing filters of paper having a GSM of between 50 and 100 g/m$^2$. For example, interposing a filter in the path of an electron gun having an acceleration voltage of at least about 100 kV, may reduce the depth of penetration of the electrons by about 50 to 100 microns.

The best results were obtained with a mixture of high density polyethylene as thermofusible polymer and trimethylol propane trimethacrylate as radical activator, the latter being present at a rate of the order of 20% by weight with respect to the thermofusible polymer, in the case of the mixture of these two components being initially made in the aqueous dispersion serving for the deposit of dots of polymer. These best results were obtained by employing a dose of electrons of 50 kGy and a filter of 56 g/m$^2$. The bonding tests showed a substantial increase in the forces of bonding, under the same conditions and at the same temperature, with respect to a control sample not having undergone electron bombardment. Moreover, tests of passage were carried out, in which a sample of interlining is folded on itself so as to apply two back faces not presenting a dot of thermofusible polymer against each other, and the force necessary for separating these two faces after application of a pressure at a temperature included between 150 and 170° C., is measured. These tests have shown a virtual disappearance of the forces of separation, signifying the passage of the thermofusible polymer through the interlining support, for the samples subjected to electron bombardment. On the contrary, these forces of separation remained considerable for the control sample not subjected to electron bombardment, for a temperature of application of 150° C., they were of the order of 25 to 30% of the forces of bonding, i.e. the forces necessary for separating the front face of the sample applied on an article of reference.

It would be possible to reduce the relative quantity of radical activator with respect to the thermofusible polymer by proceeding with a prior mixing operation intended to have a more intimate contact between the radical activator and the thermofusible polymer. To that end, the thermofusible polymer and the radical activator are mixed in the form of powders and this mixture is subjected to successive operations of melting, extrusion and crushing so as to obtain a powder which is then placed in aqueous dispersion to form the paste serving for the deposit of dots of thermofusible polymer on the front face of the interlining support.

It should further be noted that this effect of increase of the melting temperature of the thermofusible polymer may also be obtained by adding in the dispersion of polymer a hardenable filler, i.e. a filler which, under the action of the electron bombardment or the radical activator will irreversibly polymerize and harden, consequently no longer being thermally reactivable as is the case of thermofusible polymer. Acrylic monomers form part of hardenable fillers. Thus if it is of the acrylic type itself, the radical activator may also partly constitute a hardenable filler.

In another embodiment, the electron bombardment is effected on the front face 2*a* of the support 2. The operating conditions of the electron bombardment, the thermofusible polymers, and the activators are selected so as to have the opposite effect to that of the first example, namely a decrease of the melting temperature and/or viscosity of the polymers under the action of the electron bombardment. Apart from that difference, the considerations given hereinabove remain valid.

In this case, a copolymer having a melting temperature of 140° C. is brought, in the zone subjected to electron bombardment radiation, to a temperature of 100/120° C.

What is claimed is:

1. Process for manufacturing a thermobonding interlining in which dots of thermofusible polymer of mean thickness E are deposited on a front face of an interlining support having opposing front and back faces, chosen from textile and non-woven supports, and one of the opposing faces of the support is subjected to electron bombardment, and the dots of thermofusible polymer subjected to electron bombardment are a solid medium, wherein the dots of thermofusible polymer contain a radical activator and are bereft of photoinhibitor, a depth of penetration of electrons in the dots of thermofusible polymer is adjusted in order to obtain a differentiation of the physico-chemical properties of the thermofusible polymer, chosen from the group consisting of melting temperature and viscosity, over a limited thickness e with respect to the mean thickness E.

2. The process of claim 1, wherein the back face of the interlining support is subjected to electron bombardment, the limited thickness e is between 10 and 50% of the mean thickness E, wherein the modification of the physico-chemical properties of the thermofusible polymer causes an increase in the melting temperature of said polymer.

3. The process of claim 1, wherein the front face of the interlining support is subjected to electron bombardment, the limited thickness e is between 50 and 90% of the mean thickness E, wherein the modification of the physico-chemical properties causes a decrease in the melting temperature of said polymer.

4. The process of claim 1, wherein the depth of penetration of the electrons is reduced by interposing a filter on the path of a beam of electrons.

5. The process of claim 4, further comprising interposing a filter on the path of the beam of electrons, wherein the acceleration voltage of the beam of electrons is at least 100 kV and the depth of penetration of the electron beam is decreased between 50 and 100 $\mu$m.

6. The process of claim 4, wherein a paper having a GSM of between 50 and 100 g/m$^2$ is used as filter.

7. The process of claim 1, wherein the radical activator is a monomer of an acrylic selected from the group consisting of trimethylol propane trimethacrylate and trimethylol propane triacrylate.

8. The process of claim 7, wherein the thermofusible polymer is a high density polyethylene, and the radical activator is trimethylol propane trimethacrylate at a rate of 5 to 20% by weight with respect to the high density polyethylene.

9. The process of claim 1, wherein, to prepare an aqueous dispersion in the form of paste containing the thermofusible polymer and the radical activator for depositing the dots of polymer on the front face of the interlining support, the thermofusible polymer and the radical activator are previously mixed in the form of powders, this mixture is subjected to successive operations of melting, extrusion and crushing so as to obtain a powder which is diluted in water to obtain said aqueous dispersion.

10. The process of claim 1, wherein a variation of melting temperature in a zone subjected to electron bombardment is of the order of 10 to 20° C.

11. The process of claim 1, wherein the dots of thermofusible polymer further include a hardenable filler.

12. The process of claim 2, wherein the limited thickness e is between 10 to 20% of the mean thickness E.

13. The process of claim 3, wherein the limited thickness e is between 80 to 90% of the mean thickness E.

14. The process of claim 11, wherein the filler is polymerized and hardened under the action of electron bombardment.

15. The process of claim 11, wherein the filler is polymerized and hardened under the action of the radical activator.

* * * * *